169-46 SR

7/22/80 OR 4,213,501

United States Patent [19]

Pfeiffer et al.

[11] 4,213,501

[45] Jul. 22, 1980

[54] PROCESS AND DEVICE FOR EVAPORATING LARGE QUANTITIES OF LOW BOILING LIQUEFIED GASES

[75] Inventors: Ferdinand Pfeiffer; Leo Rottwinkel, both of Düsseldorf, Fed. Rep. of Germany

[73] Assignee: Messer Griesheim GmbH, Frankfurt am Main, Fed. Rep. of Germany

[21] Appl. No.: 844,596

[22] Filed: Oct. 25, 1977

[30] Foreign Application Priority Data

Nov. 13, 1976 [DE] Fed. Rep. of Germany ..... 2651849

[51] Int. Cl.[2] ..... A62C 1/00

[52] U.S. Cl. ..... 169/46; 62/52; 431/242; 431/353; 169/64

[58] Field of Search ..... 62/52, 53; 431/242, 431/243, 247, 353, 347; 169/11, 46, 47, 64

[56] References Cited

U.S. PATENT DOCUMENTS

| | | | |
|---|---|---|---|
| 773,383 | 10/1904 | Friedmann et al. | 431/242 |
| 2,111,239 | 3/1938 | Elze | 431/242 |
| 2,539,291 | 1/1951 | Williamson et al. | 62/52 |
| 3,101,593 | 8/1963 | Britton et al. | 431/242 |
| 3,171,389 | 3/1965 | Throckmorton et al. | 122/333 |
| 3,421,574 | 1/1969 | Kals | 62/52 |
| 3,477,412 | 11/1969 | Kitrilakis | 62/52 |
| 3,591,962 | 7/1971 | Connell | 62/52 |
| 3,830,307 | 8/1974 | Bragg et al. | 169/9 |

FOREIGN PATENT DOCUMENTS 2106830 5/1974 Fed. Rep. of Germany .

*Primary Examiner*—Ronald C. Capossela
*Attorney, Agent, or Firm*—Connolly and Hutz

[57] ABSTRACT

Large amounts of low boiling liquefied gases are evaporated by heat transfer in a cylindrical combustion chamber without a convection component and a passage for the gas to be evaporated surrounds the combustion chamber so that the liquefied gas is exposed to a burner flame upon entry into the passage.

10 Claims, 1 Drawing Figure

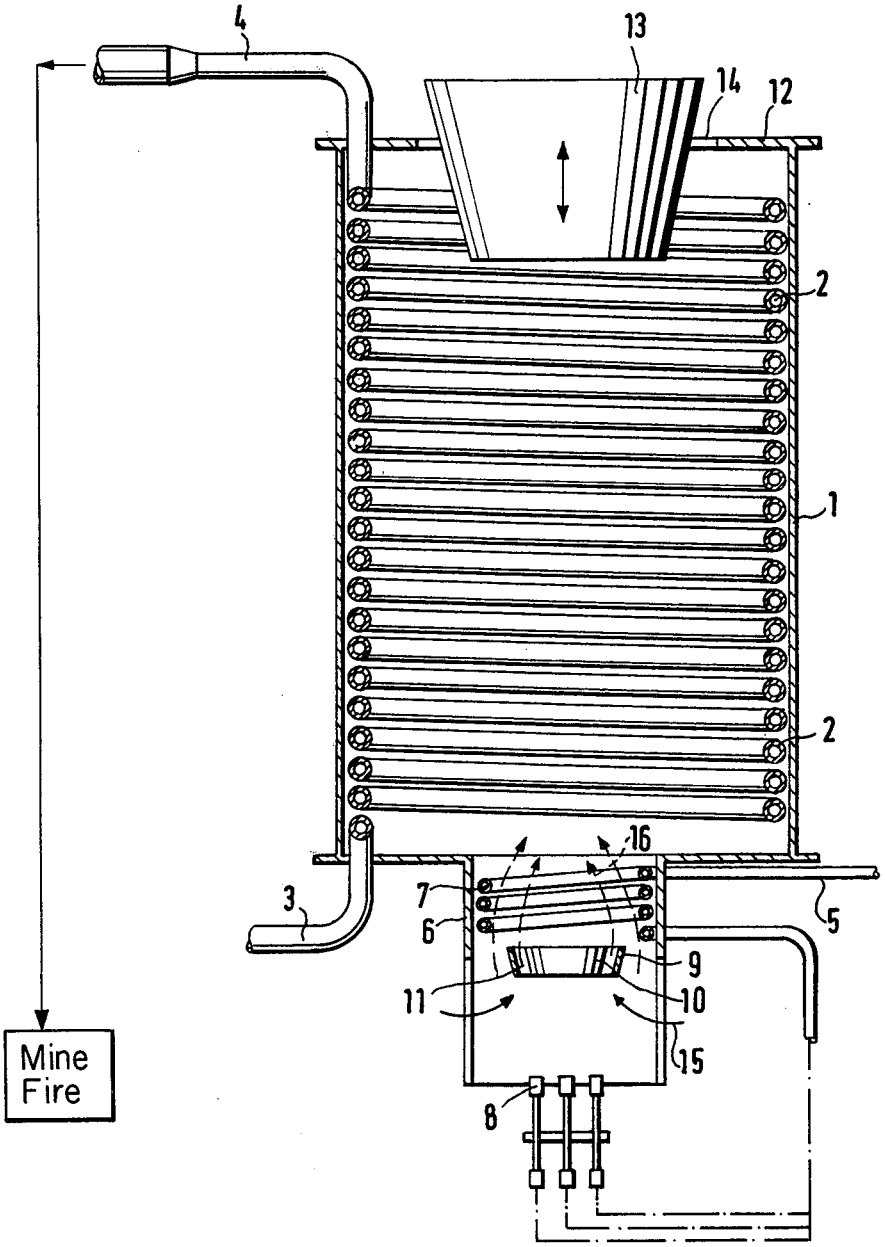
4
13
14
12
2
1
2
16
3
7
6
5
9
11
10
15
8
Mine
Fire

PROCESS AND DEVICE FOR EVAPORATING LARGE QUANTITIES OF LOW BOILING LIQUEFIED GASES

BACKGROUND OF THE INVENTION

This invention is concerned with a process and device for evporating large amounts of low boiling gases, especially for the evaporation of nitrogen for fighting mine fires. The invention is, however, not restricted to this use, but can be adapted to all cases where large amounts of gas must be obtained by evaporation of the liquid phase of the gas. This can, for example be the preparation of inert gas to render tankers inert, or the evporation of liquefied natural gas for peak load service.

Mine fires used to be combatted by walling off all accesses to the furnace of the fire in order to choke off the supply of air to the location of the fire. It would usually take years until such a fire would choke by itself on account of scarce air supply. It happened often, thereby, that the fire would flare up anew as soon as sealing walls were opened.

With mine fires, the requirements are set. Since nowadays very expensive machines are put in, it represents a very high financial loss, if these machines cannot, under the circumstances be used for years. Under these circumstances, they even represent a total loss, if they are technologically revised during the years of the fire. Therefore, it is desirable to more quickly bring mine fires under control and to extinguish them faster.

Successful in this area has been gaseous nitrogen, which is carried by a pipeline through the shaft and brought directly to the furnace of the fire by means of tubular probes, so that the fire is choked. As a rule, one usually succeeds, in this manner to extinguish the fire within fewer weeks or months.

In connection with this, very large quantities of nitrogen in the magnitude of several thousand $Nm^3$/hr. required. As a rule, this nitrogen cannot be obtained in the gaseous state from an air separation plant, so that it must be channeled into the shaft in liquid form and evaporated there. For this, one often uses a heat exchanger unit with water as the exchange medium. The water is heated in a separate chamber by immersion heaters and rotated by a pump. The liquid nitrogen flows through tubular coils on the rotating water bath and evaporates. Such an installation is extensive and requires a high investment cost. Considerable transportation and installation costs arise from the weight of the equipment. The bottom must be provided with a stable foundation. Also the operation of the equipment is expensive and complicated. The operation of the blowers or compressors for the immersion heaters and for the water circulating pump causes a substantial current demand. Adjustment is difficult since the temperature of the evaporated nitrogen as well as that of the circulating water must be tuned to each other.

SUMMARY OF THE INVENTION

The object of the invention is to find a process and device for evaporating large amounts of low boiling liquefied gases by transfer of heat produced by burning a combustible gas, which needs only simple and light equipment, which can do without auxiliary energy in the form of electric current and which is regulated in a simple fashion.

Such a process was found, with which, according to the invention the heat transfer occurs in a heat which consists essentially of a cylindrical combustion chamber without convection component (as in German Pat. No. 2,106,830 and a passage surrounding the cylindrical combustion chamber for the gas to be evaporated in such manner that the liquid gas is exposed upon entry into the passage to a burner flame with a maximum radiation.

The passage for the gas to be evaporated can, for example, be a spirally winding pipeline, so that it itself forms the cylindrical combustion chamber. It can also be a simple annulus which if necessary can be provided with walls so that the liquefied gas travels around the combustion chamber in a screw shaped pattern. Such heaters which are of a very simply construction are known from the German Pat. No. 2,106,830. As used in the specification and claims the reference to heaters having a radiation component and being free of a convention component is meant to refer to such known heaters of the type described in German Pat. No. 2,106,830. Upon entry of the liquid, boiling gas into the heater there results a bubbling evaporation with extremely high heat transfer. Therefore, in order to avoid icing at this part of the heater the supply of heat occurs, according to the invention, by means of a burner flame with a maximum radiation. The intensive supply heat from radiation prevents an ice coating on the inner wall of the heater.

A flame with maximum radiation can be obtained from every burner which is operated with premix. With these burners, the combustible gas is premixed in the burner with at least part of the air used in combustion, so that the burner flame need not draw any or only a part of the air needed for combustion. Typical burners of this type are oxy-acetylene welding torches and Bunsen burners. With these burners the danger of backfire cannot be completely ruled out. For the preferred field of application of the invention, namely, the fighting of mine fires, a safer continuous operation for weeks or months without steady human supervision is demanded. The possibility of a backfire must, therefore, be completely ruled out. A further object of the invention consists of producing a burner flame with maximum radiation, with which the danger of backfire does not exist.

According to the invention this object is thereby achieved since at least one gas burner is operating as a premix burner with which the gas coming out of the nozzle takes up part of the required air for combustion from the space and the so formed primary flame strikes a deflector plate which is mounted near the entrance of the combustion chamber and behind which the secondary air is sucked in and a flame with a maximum radiation is produced.

With this method in accord with the invention a backfire is completely ruled out. Basically this method amounts to steadily working with a backfire (primary flame), while on the other hand, on the other side of the deflector plate, all advantages, especially maximum radiation of a flame with premix are obtained.

According to an advantageous form of the invention, the deflector plate consists of concentrically mounted deflector rings which actually represent parts of a cone shaped shell and together form an inclined ring slot directed onto the wall of the combustion chamber. Before these deflector rings, gas burner nozzles are mounted in a circle and are directed at the inner side of the smaller deflector ring. The deflector rings and the gas burner nozzles are mounted in a tube shaped guide piece in the end of the combustion chamber facing the burners.

The end of the combustion chamber opposite the burner is advantageously designed as a deflector insert. The smoke gases can escape through a ring slot between the deflector insert and the end wall or the combustion chamber wall. It is advantageous to make the deflcetor insert adjustable in an axial direction and to design it so that it forms a conical ring slot with the combustion chamber wall or the end wall. The width of the ring slot can then be altered by axially adjusting the deflector insert. The pressure to be maintained in the combustion chamber can be easily optimized by adjusting the deflector insert.

The pressure to be built up in the combustion chamber also depends upon the type of gas burner nozzle used. Normal welding nozzles have proven to be best suited to this purpose.

A well suited combustible gas is propane which can be drawn in liquid form from a propane bottle. In order to obtain a sufficient evaporation the propane supply line can be coiled around the tube shaped guide piece containing the burners or mounted in the form of a coil in the interior of the guide piece. One could avoid the difficulties which are connected with the production of a flame with maximum radiation by using a conventional heater with a large convection component. Many pipe assemblies with partitions would however be required for this. A complicated trouble prone and expensive welding construction would result. The goals of the invention could not be attained with this.

THE DRAWINGS

The single FIGURE illustrates schematically in cross-section a device for evaporating liquid nitrogen with propane as fuel gas in accordance with this invention.

DETAILED DESCRIPTION

The inventive device consists of a combustion chamber wall 1 in which a pipeline 2 is densely coiled, in which the liquid nitrogen evaporates. The liquid nitrogen enters the device via line 3 and leaves it in the gaseous state via line 4 whereby it may be used to extinguish a mine fire, as schematically illustrated. Instead of a pipeline, an annulus with a helix and also if necessary without a helix can be used. The fuel gas propane arrives in the device via line 5 is evaporated in the spiral pipe coils 7 along the inner wall of the guide piece 6 and channeled to the gas burner nozzles 8. In the tube shaped guide piece 6 there are according to the invention two concentric deflector rings 9 and 10 which actually represent a cone shaped shell and together form an inclined ring slot 11 directed at the combustion chamber wall. The gas burner nozzles are mounted in a circular configuration so that they are aimed at the inner side of the smaller deflector ring 10. An optical admixture of the secondary air with the flame is achieved. The number of gas burner nozzles 8 depends on the size of the heater. In the end wall 12 opposite the heater there is a conical deflector insert 13 which can be axially shifted as indicated by the double headed arrow by means of an arrangement which is not illustrated. The slot 14 between the end wall 12 and the deflector insert 13 can be altered in this fashion. The smoke gases escape through the slot 14 and depending on the width of the slot various pressures can be set in the combustion chamber so that an optimal operation of the equipment can be easily achieved. In the tube shaped guide piece 6 there area in the area of the gas burner nozzles 8 openings via which the primary air, about 60% of the total combustion air is sucked in. This primary air is indicated with crossing through arrows 15. There results a primary flame which strikes the inner side of the smaller deflector ring 10. The primary flame becomes turbulent here and there results a hot mixture of gases reacting with one another consisting of propane and primary air. This gas mixture now sucks in the secondary air about 40% of the total combustion air. The secondary air flow through the ring slot 11 formed by the deflector rings 9 and 10 as well as through the slot formed by the deflector ring 9 and the guide piece 6 into the combustion chamber. The secondary air is indicated with dotted arrows 16. An incandescent flame with maximum radiation thereby results in the combustion chamber. The liquid nitrogen which flows into the combustion chamber through line 3 immediately begins to evaporate with a bubbling evaporation. The type of evaporation is connected with an extremely high heat transfer so that one would expect an icing of the inner combustion chamber wall which is formed by the pipe coils 2. As a result the heater would be functional in the shortest time. However as a result of the intensive radiation of the flame formed according to the invention, such an ice formation is avoided.

The device is regulated by means of a not illustrated temperature or thermostatic probe mounted in line 4. As soon as the temperature of the outcoming gaseous nitrogen becomes too high the burner is shut off. If the temperature sinks below the predetermined value the burner is ignited again.

The inventive device is light and can if need be transported quickly to the location of usage and set up. Except for the regulation it does not require any electrical energy. Compared to previous devices for evaporating liquid nitrogen, it is extremely valuable. It has proven itself admirably in a month's long use with a mine fire.

What is claimed is:

1. In a process for continuously evaporating large amounts of low boiling liquefied gases by the transfer of heat produced by the combustion of a combustible gas, the improvement being effecting the heat transfer in a heater which consists essentially of a cylindrical combustion chamber having a radiation component and being free of a convection component, disposing a passage around the cylindrical combustion, conduction the gas to be evaporated through the passage, exposing the liquefied gas to a burner flame with radiation maximum upon entry into the passage, producing the burner flame with maximum radiation by at least one gas burner operated as a premix burner, utilizing the gas coming out of the nozzle to take up part of the air required for combustion from the room and directing the so-formed primary flame to strike a deflective plate mounted near the entrance to the combustion chamber and sucking the secondary air in behind the deflector plate to produce a flame with maximum radiation.

2. Process according to claim 1, the improvement being channelling the gas to be evaporated in a spiral path in a pipeline around the cylindrical combustion chamber.

3. Process according to claim 2, the improvement being utilizing nitrogen as the liquefied gas, and directing the resultant gas against a mine fire to extinguish the fire.

4. A device for evaporating large amounts of low boiling liquefied gases by the transfer of heat produced by the combustion of a combustible gas comprising a housing having a cylindrical combustion chamber formed with a radiation component and being free of a convection component, a passage in said housing around said chamber, an inlet at one end of said passage for the continuous admission of the liquefied gas therein, an outlet at the opposite end of said passage for the exit of the resultant gas therefrom whereby the gas to be continuously evaporated may be conducted therethrough, burner means in the general area of said inlet for having a flame with radiation maximum to which the liquefied gas is exposed upon entry into said passage, said passage being in the form of a spiral wound pipe, said burner means having means for the admission of primary air and secondary air including an outwardly directed tubular shaped guide piece extending from the end wall of the housing forming said chamber, a pair of concentric deflector rings mounted in said guide piece forming part of a cone shaped shell with an inclined annular slot directed at the wall of said chamber, and a circular array of gas burner nozzles directed at the inner surface of the inner of said deflector rings.

5. Device according to claim 4, characterized by a deflector insert in the end wall of said combustion chamber opposite said burner means for providing an exit for the smoke gases.

6. Device according to claim 5 characterized by the fact that said deflector insert is adjustable in an axial direction and forms a conical annular slot with a wall of said combustion chamber.

7. Device according to claim 6, characterized by the fact that said burner means including a gas supply line for said gas burner nozzles, and said gas supply line being spirally wound within said tube shaped guide piece.

8. Device according to claim 4, characterized by the fact that said burner means including a gas supply line for said gas burner nozzles, and said gas supply line being spirally wound around said tube shaped guide piece.

9. Device according to claim 4 wherein said guide piece is slotted for the admission of primary air therethough, and said secondary air being introduced behind said deflector rings.

10. Device according to claim 4 wherein gas burner nozzles are directed toward the inside of the inner of said deflector rings.

* * * * *